US005323723A

United States Patent [19]

Askin

[11] Patent Number: 5,323,723

[45] Date of Patent: Jun. 28, 1994

[54] SEWING MACHINE ASSEMBLIES

[75] Inventor: Michael Askin, Huntingdon, England

[73] Assignee: Insituform (Netherlands) BV/SA, Rotterdam, Netherlands

[21] Appl. No.: 934,639

[22] PCT Filed: Mar. 6, 1991

[86] PCT No.: PCT/GB91/00349

§ 371 Date: Sep. 17, 1992

§ 102(e) Date: Sep. 17, 1992

[87] PCT Pub. No.: WO91/14036

PCT Pub. Date: Sep. 19, 1991

[30] Foreign Application Priority Data

Mar. 10, 1990 [GB] United Kingdom ..... 9005408

[51] Int. Cl.[5] ..... D05B 3/00; D05B 27/00

[52] U.S. Cl. ..... 112/121.14; 112/307; 112/155

[58] Field of Search ..... 112/121.14, 321, 273, 112/277, 112, 272, 80.18, 121.11, 278, 271, 155, 307; 74/55, 569; 250/563, 572

[56] References Cited

U.S. PATENT DOCUMENTS

| | | | |
|---|---|---|---|
| 260,130 | 6/1882 | Smith | 112/121.14 |
| 1,103,587 | 7/1914 | Houston | 112/121.14 X |
| 1,731,001 | 10/1929 | Gail | 112/272 X |
| 4,102,283 | 7/1978 | Rockerath et al. | 112/131 |
| 4,327,653 | 5/1982 | Blessing | 112/121.14 |
| 4,343,998 | 8/1982 | Mori | 250/563 |
| 4,413,580 | 11/1983 | Moyer et al. | 112/262.2 |
| 4,848,252 | 7/1989 | Ciucani | 112/62 |
| 4,883,006 | 11/1989 | Marii et al. | 112/121.14 X |

FOREIGN PATENT DOCUMENTS

| | | | |
|---|---|---|---|
| 60-034663 | 2/1985 | Japan | 112/80.18 |
| 63-267390 | 11/1988 | Japan | 112/155 |
| 2027191 | 2/1980 | United Kingdom | 112/278 |

*Primary Examiner*—Clifford D. Crowder
*Assistant Examiner*—Paul C. Lewis
*Attorney, Agent, or Firm*—Fred Philpitt

[57] ABSTRACT

The invention provides that a sewing machine is used for sewing the adjacent edges of a flat felt web which is folded to bring the edges together. The web moves past the sewing machine, and the sewing machine is mounted so as to reciprocate in a forward stroke in the direction of the web during the stitching, and to move rearward back to an initial position to effect the next stitch. The drive mechanism of the sewing machine is such that from the commencement of the forward stroke the machine is accelerated up to the speed of the web the needle penetrates the web and effects the stitch, the needle is removed from the web, and then is decelerated to zero before completing the backstroke. The invention also relates to an optical sensing mechanism for examining the presence of stitches.

15 Claims, 7 Drawing Sheets

SEWING MACHINE ASSEMBLIES

This invention relates to sewing machine assemblies, and relates particularly but not exclusively to sewing machine assemblies for the sewing of overlapped edges of thick textile material, such as needle felts in the order of a thickness of 6 mm or more.

It is known to utilise tubular felt materials as tubular linings for underground pipelines and passageways, for example as set forth in British Patent Specification 1449455, and in order to construct such tubular lining materials, a flat web of textile material typically a needled felt is folded into tubular form until the free edges overlap, and then they are sewn together by an appropriate sewing machine so that the material will retain its tubular form. As these webs are formed into long sections of tubular material, it is usual to keep the sewing machine stationary, and to feed the web past the machine in order to effect the stitching.

In fact, in order to avoid side loading on the sewing needle, it is usual to advance the web by means of a dog feed arrangement so that the web is in fact stationary as the needle penetrates the material and then leaves same in order to form the stitch, following which the material is advanced and the stitch feeds it and so on. This method of sewing tends to slow down the process, and to give rise to inertia problems and inefficiencies.

The present invention provides a sewing machine assembly whereby this disadvantage can be overcome, and in accordance with the present invention, the sewing machine is mounted so that it is capable of movement in the direction of feed of the workpiece (e.g. a needle felt web) past the sewing machine so that the sewing machine is travelling at the same speed as the workpiece as the machine needle enters and leaves the workpiece, said sewing machine being connected to a drive mechanism for the oscillation of same to provide the sewing machine with a forward stroke and a return stroke, and within the forward stroke the sewing machine is accelerated up to the speed of movement of the work piece before the needle penetrates the work piece, and is decelerated to zero after the needle leaves the work piece upon completion of the stitch.

Preferably, there is control means for controlling the said acceleration and deceleration depending upon the speed of movement of the workpiece.

Said control means may embody a microprocessor for varying the said acceleration and deceleration depending upon the said speed of movement of the work piece, which preferably is constant.

The movement of the sewing machine may be controlled by means of two cams so that during one cycle of operation, the forward stroke of the sewing machine is effected over an angular extent of the cycle of 270 degrees, whilst during the remaining 90 degrees the sewing machine is moved back to the beginning of the forward stroke position.

A drive motor may be used for driving said cams, and the sewing machine is preferably mounted on linear anti-friction bearings.

The sewing machine is preferably adapted to sew overlapped edges or face to face edges of needle felt material which is either plain felt or is felt provided on one side with a synthetic resinous material impermeable coating such as polyurethane.

The sewing machine of the assembly may be of commercially available construction.

An embodiment of the present invention will now be described, by way of example, with reference to the accompanying diagrammatic drawings, wherein.

Figure 8:
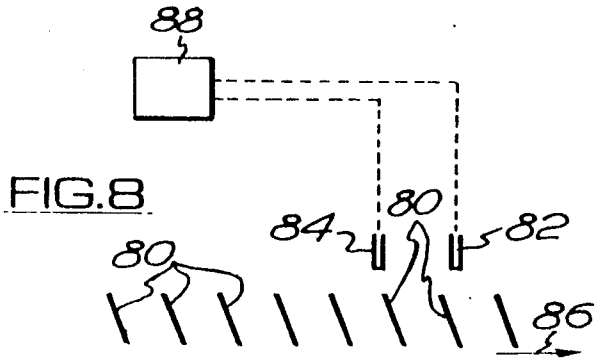
Figure 7:
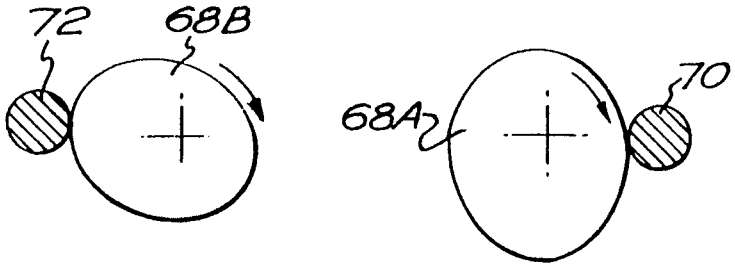
Figure 2:
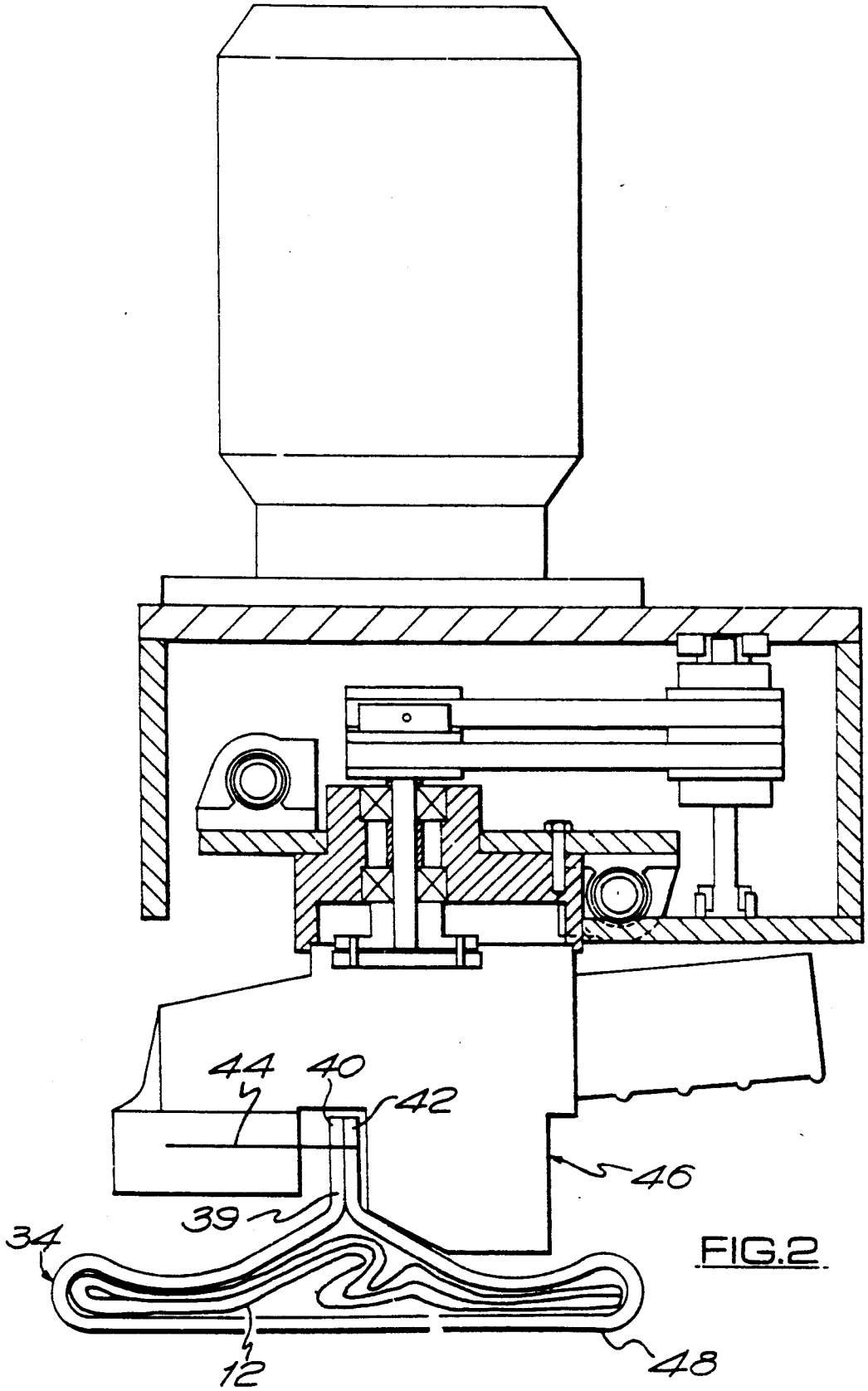
FIG. 2 is a part-sectional end view of a sewing machine head for sewing the outer layer of material in the arrangement of FIG. 1.
Figure 3:
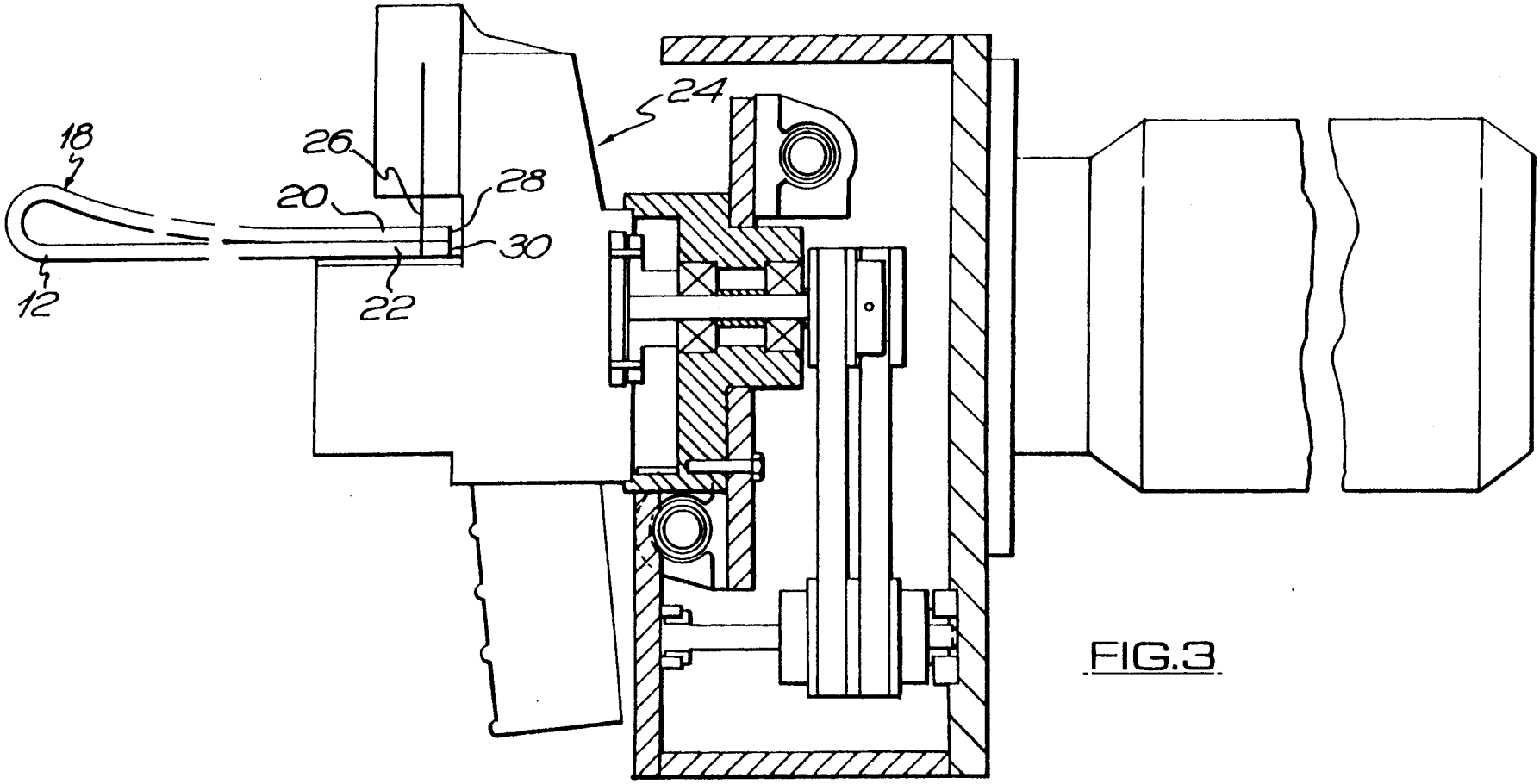
FIG. 3 is a view similar to FIG. 2, but showing the sewing machine head which is used for sewing the inner layer of the lining material in the arrangement of FIG. 1.
Figure 4:
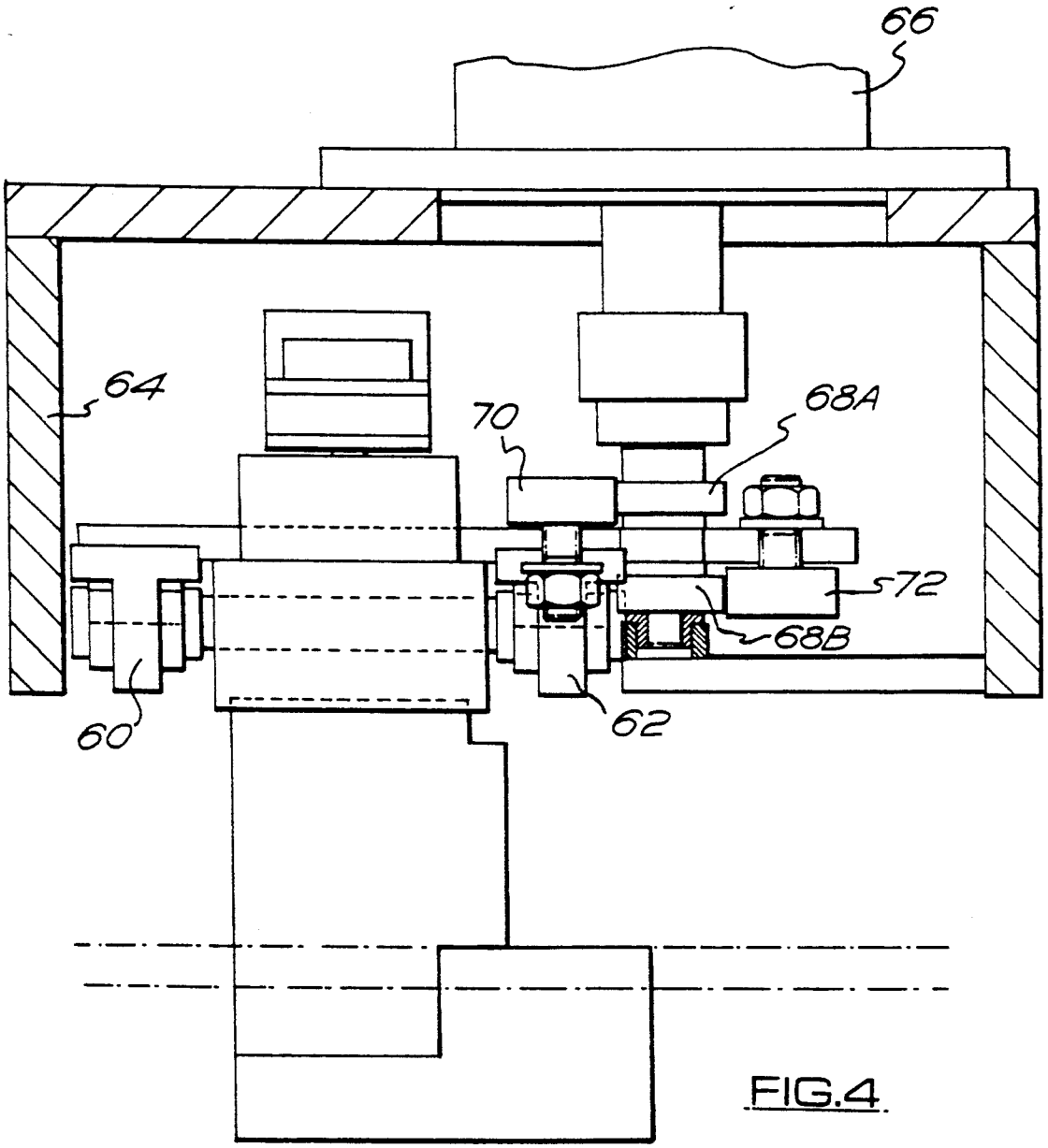
Figure 5:
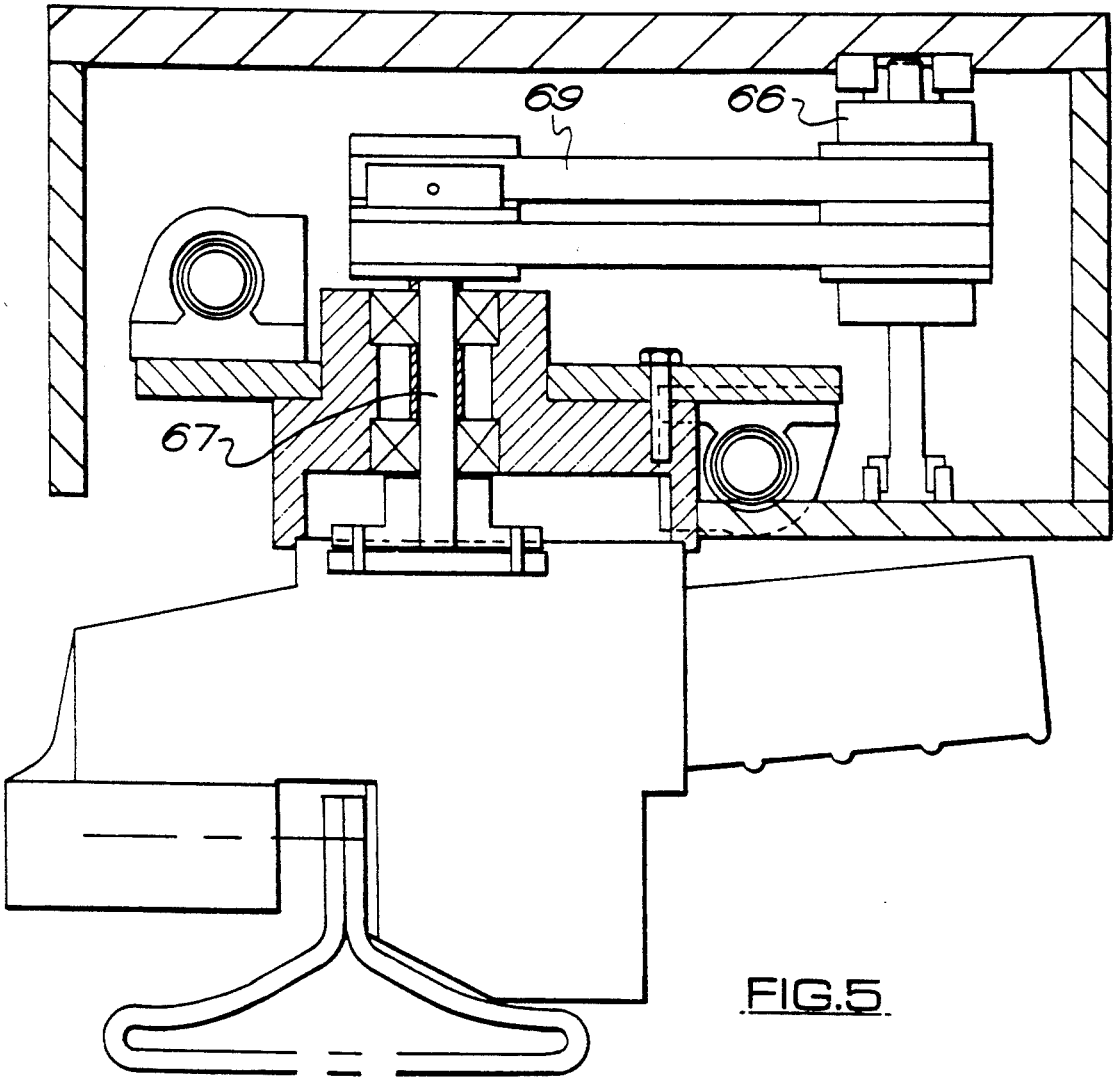
Figure 6:
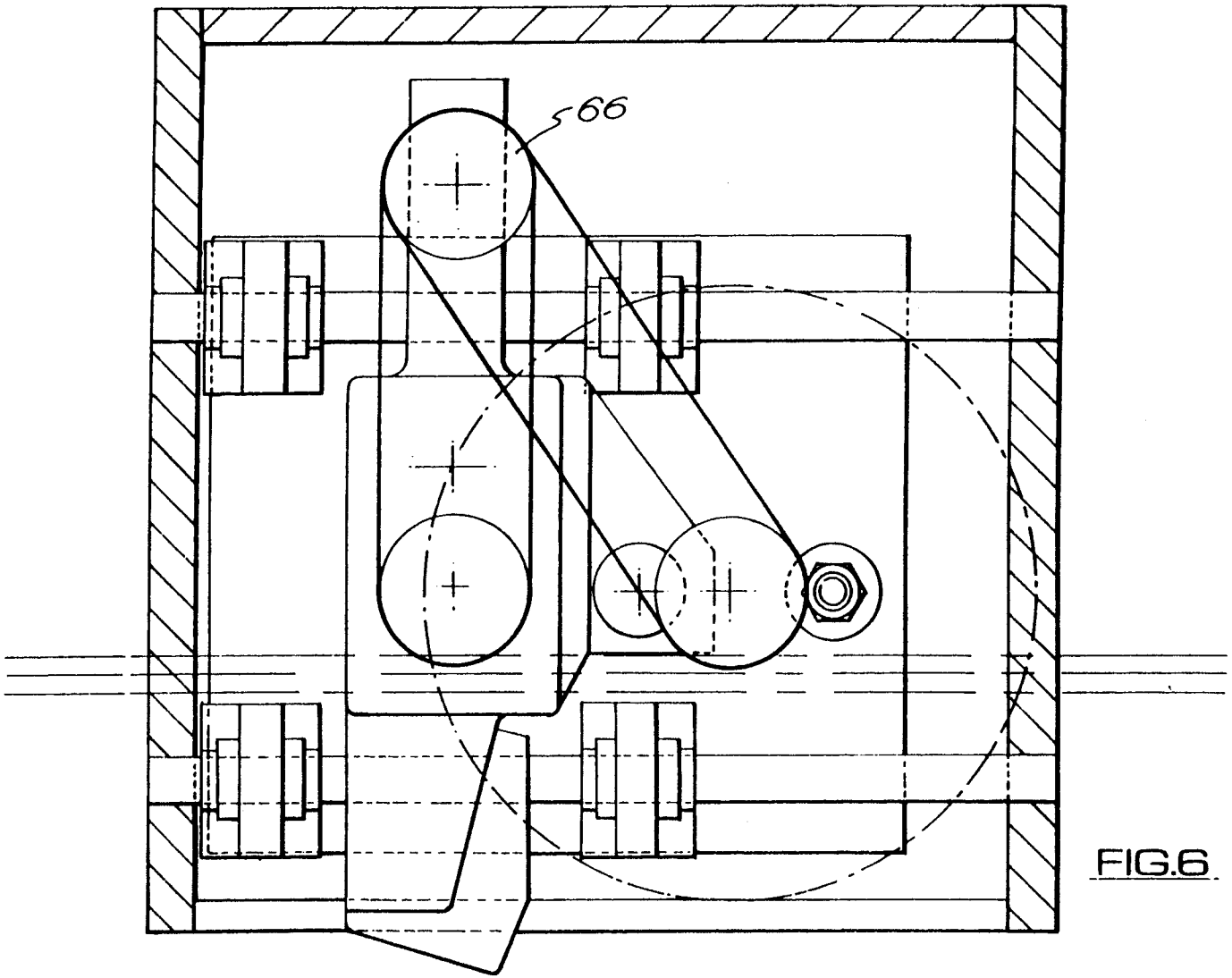

FIGS. 4, 5 and 6 respectively show a part-sectional side view, a part sectional end view and a plan view of a sewing head and its mounting, the sewing head being either a sewing head of FIG. 2 or the sewing head of FIG. 3;

FIG. 7 is a diagrammatic view to explain the operation of the cam drive;

FIG. 8 is a view to illustrate the sewing system; and

Figure 9:
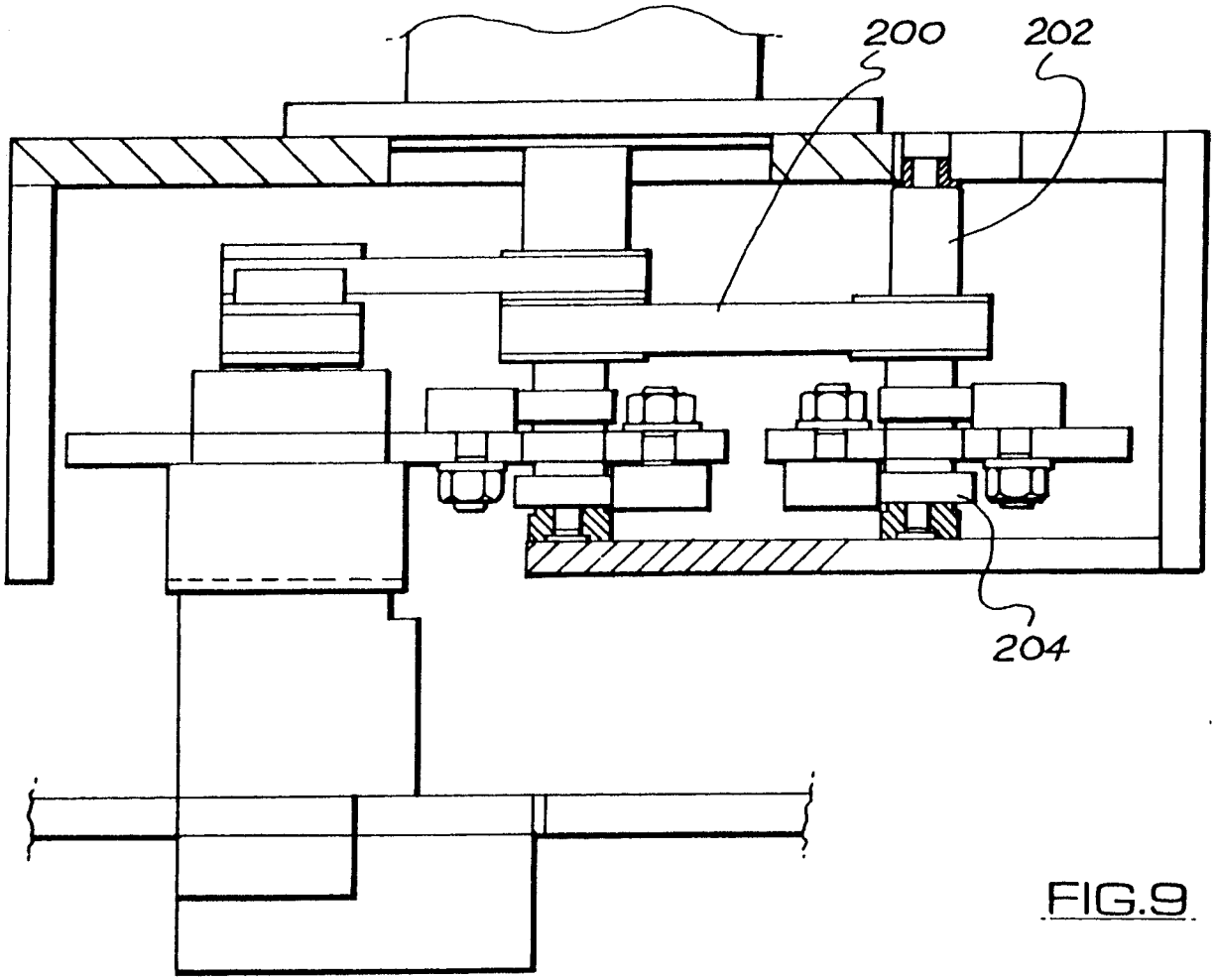

FIG. 9 shows a modified drive arrangement for the sewing machine.

Figure 1:
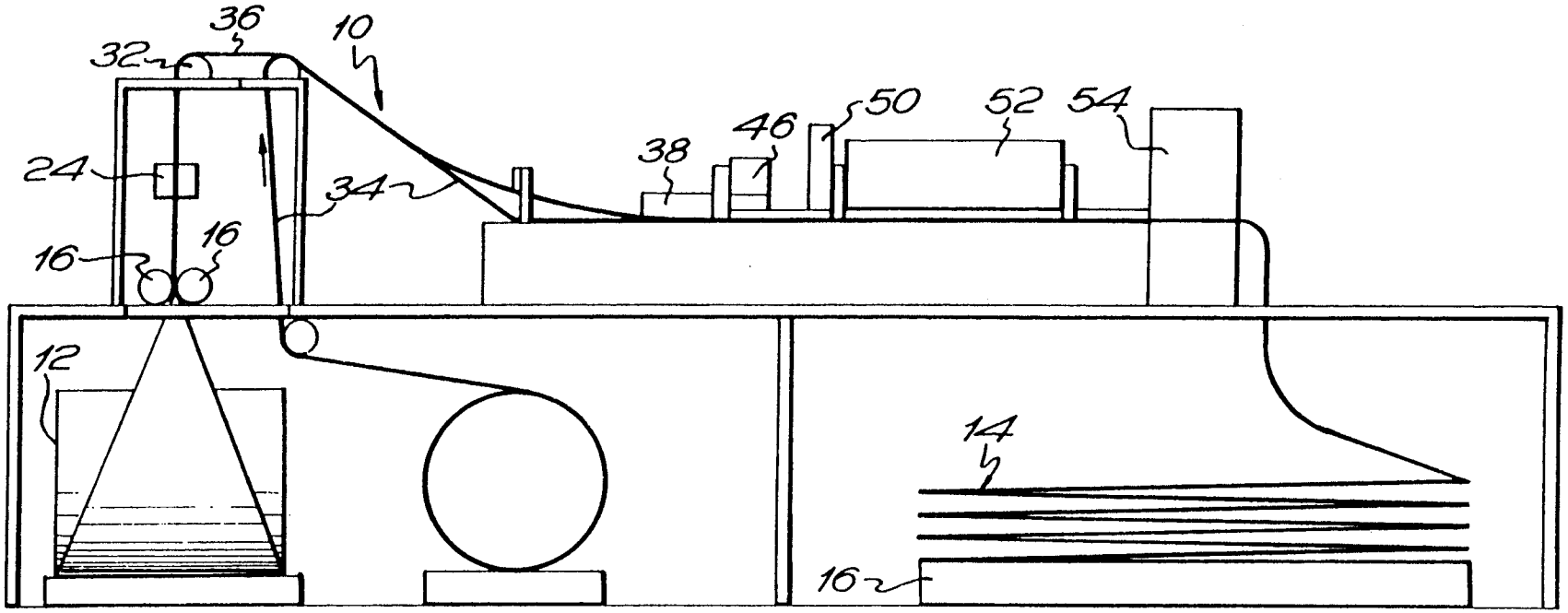
FIG. 1 is a diagrammatic side view of a machine for forming tubular lining material.

Referring to the drawings, and firstly to FIG. 1, a machine for producing tubular lining materials for soft lining processes is illustrated generally by reference numeral 10. This particular machine is for producing lining materials in tubular form made up of an inner layer of needled felt which has no coating on either side, and an outer layer of needled felt which is provided on one side with a coating to define the impermeable membrane referred to herein. It should be mentioned that if tubular materials of more than two layers are to be produced, then the machine would be extended to the left hand side as shown in FIG. 1 to provide further mounting arrangements for additional rolls of plain felt.

In FIG. 1 a roll of plain felt is indicated by reference 12, and it serves to form the inner layer of the fininshed tubular material which is shown as being stacked at 14 in concertina fashion on a suitable pallet 16. The roll of felt is unrolled continuously from roll 12 and is folded in two by means of forming rollers so that the felt web takes up the condition shown at 18 in FIG. 3 wherein the felt is folded in two so that the free edges 20 and 22 come face to face. These edges are fed through a sewing machine 24 which is of conventional construction and in fact is a machine made by the Italian company Elcu-Sud Impianti, Model No. TC 101. The machine is a portable unit supplied with a low voltage electric motor drive and a built-in cutter to prepare the edges 20 and 22 of the material to be sewn. The edges are sewn along the line 26 inwardly of the extremeties thereof by sewing loops of a particular size so that when the material 12 is subsequently opened up to circular form as described, the extremeties 28 and 30 of the edges will come into butting contact.

The now sewn web 12 passes from the sewing machine over a guide roller 32 and onto the fibre surface of the travelling outer web 34 as indicated by reference 36 and the folded and sewn web 12 is carried by the web 34 through a guiding system 38 which ploughs up the edges of the outer web 34 to fold the web into tubular form so that the edges come into butting contact as indicated by reference 39 in FIG. 2 with the extremeties of the edges 40 and 42 in the same plane. These face to face edges are sewn together along line 44 by a sewing machine 46 which is of identical construction to the sewing machine 24 which is used for sewing the edges of the inner web. Again the edges of the outer web 34 are sewn by loop stitches so that when the outer layer 34 is moved to circular form, the extremeties 40 and 42 come into butting contact. It is to be mentioned that the outer surface 48 of the layer 34 comprises the coating material and that the inner web 12 is located inside the outer web 34 as shown. As the inner layer eventually has to lie outside the outer layer, circumferentially it may in fact be larger than layer 34.

The sewing machine 46 is illustrated in FIG. 1, and when the multi-layer tubular lining material leaves the sewing machine 46 it passes to a tape application unit 50 which may be of the nature as described in said European application, and this is followed by a unit 52 which applies heat to seal the tape, and which also embodies a recognition system for examining the stitches of the sewing. The recognition system preferably utilises close circuit television based image recognition, and the inspection of the stitching can be carried out using thread sensors of the optical type (as described hereinafter) linked to a programmable controller of the machine in order to detect stitch failure e.g. breakage or absence so that as soon as possible faults can be identified whereby the time taken to correct the fault is minimised and manual repair work can be carried out under factory conditions rather than on site which occurs if the failure or fault is not discovered until the material reaches the site.

The combined lining material is fed through the machine by means of pull-through rollers 54 and a suitable laying up mechanism is embodied in the machine for laying the completed lining material on the pallet 16 in concertina fashion, ready for transportation to the site.

Normally sewing machines for effecting the type of stitching operation illustrated herein embody a "feed dog" to feed the material through the sewing machine in a intermittent fashion so that the material is moved only when the sewing needle is clear of same. The purpose of this is to ensure that the feed of the material does not bend or break the needle. This method of sewing has some kinetic and efficiency problems. Because the material must be stopped and started, then due to inertia it is not always the case that there is an accurate feeding of the material at each feed step. Additionally, it is inefficient to feed the material in a step-wise manner. The sewing machines and their mountings in the machine illustrated are therefore modified in order to provide a more efficient sewing system.

Basically, the sewing machines move in an oscillatory manner during the sewing operation. That is to say the sewing machine moves in the direction of feed of the material from an end stroke position until it reaches the speed matching the speed of the material when the needle is caused to penetrate the material and perform a stitch. When the stitch has been completed the needle retracts, the machine travelling at the same speed as the material so that there is no side loading on the needle and after the needle has left the material in this forward stroke, the sewing machine is decelerated to an end of stroke position, and it is returned quickly to the beginning of stroke position and the cycle repeats. During this time, the material can be moved continuously, and preferably is moved continuously at a constant speed.

By this means there is as stated no side loading on the needle which could bend or break same. The programmable control system of the machine has a function to control the movement of the sewing machine in its oscillating path so that from the beginning of the sewing stroke, the machine is accelerated up to material matching speed before needle penetration takes place, and during sewing the machine travels at the same speed as the material. On retraction of the needle the sewing machine is decelerated to end stroke position and then is quickly returned to the beginning of stroke position in time to make the next stitch in the correct position. The controller controls the acceleration and deceleration of the sewing machine in accordance with signals derived from the feed rollers 54 ensuring smooth and efficient operation.

The drive system of each sewing machine is illustrated diagrammatically in FIGS. 4, 5 and 6 and 7 to achieve such a system, the commercially available sewing machine referred to herein is modified by removing the standard motor and also the material cutter system. The body of the sewing machine is milled to improve material handling and also accurate mounting of the new drive and oscillating system. To enable the sewing machine to execute the oscillatory movements, it is carried by linear bearings 60, 62 on a mounting frame 64 which is a stationary part of the machine. The motor 66 is coupled by belt drive 69 to a drive shaft 67 carrying cams 68A and 68B which serve to effect the oscillatory movement of the sewing machine. A first cam 68A drives through a follower roller 70 the sewing machine in its forward stroke, whilst a second cam 68B drives through a follower roller 72 the sewing machine in its reverse stroke and one revolution of the drive shaft 67 represents one complete cycle of movement of the sewing machine. In the rotation of the shaft 67 the forward motion of the sewing machine takes place during 270° of rotation of that shaft whilst the rearwards motion takes place over a rotation of the remaining 90° of the shaft. The travel of the sewing machine with particular example is a stroke of as little as 3.3 mm. The linear bearings 60 and 62 are of the low friction type and are arranged in alignment with the direction in which the material moves.

If reference is made to FIG. 7 the two cams 68A and 68B are shown as are their follower rollers 70 and 72. It will be appreciated that the cams 68A and 68B are concentric on the shaft 67, and rotate together as indicated by the arrows in FIG. 7. It can be seen that starting from the position shown, rotation of cam 68A displaces follower 70 to the right in FIG. 7 commencing the forward stroke of the sewing machine and for 270 degrees cam 68A controls the forward stroke, but at the end of 270 degrees, the cam surface of cam 68A starts to reduce in radius, whilst that of cam 68B increases in radius, and cam 68B takes over and displaces follower 72 on the return stroke to the left in FIG. 7. The followers 70 and 72 are fast with the sewing machine. At the position shown in FIG. 7, the needle is clear of the felt which is moving continuously. As the cams rotate from the FIG. 7 position, the sewing machine is driven in the forward stroke in the same direction as the felt until the velocity of the sewing machine matches the velocity of the felt being sewed at which point the needle enters the felt. The needle leaves the felt near the end of the forward stroke whilst still traveling at the speed of the felt and then is returned on the return stroke to the initial position and the cycle repeats.

The type of stitch produced is arranged so that when the tube becomes circular the extremities of the material layers come face to face so that each layer will be of uniform wall thickness and the strength of the steam will be such as to be at least equal to the strength of material in tension (or hoop direction when the material is circular). The sewing machine can be arranged to sew butted edges as described in said European application or face-to-face edges as described herein and the only modification to switch from one type of sewing to another is in relation to the keels used for leading the material to the sewing machine. Such keels are embodied in the guidance system 38 in FIG. 1.

By using the machine shown in FIG. 1, a much reduced production time is achieved for any given tubular lining material, and the layout of the machine in itself constitutes a new invention.

Referring to FIG. 8, the diagram shows a plurality of stitches 80 in the outer felt 34 which are constantly sensed by optical sensors 82 and 84. It is assumed that the felt is moving in the direction of arrow 86. The sensors 82 and 84 are coupled to a microprocessor 88 so that their outputs will be processed by such processor. The two sensors work in conjunction and each has a light transmitter and receiver. As the sensor 84 sees a stitch 80, it sends a signal or count to the processor 88. The sensor 82 works in similar fashion, but upon sensing a stitch sends a signal back to the processor 88 which resets the sensor 84 so that as long as all stitches are present, the sensor 84 will only count to a level of one. The sensors 84 and 82 are spaced in the direction of feed of the workpiece, but are pitched differently from the pitching of the stitching so that sensor 84 is positioned so as to be located between stitches when sensor 82 is in register with a stitch. If a stitch is missing, then sensor 84 will miss the count indicating an error, but in order that spurious results will not be given, no warning is issued unless sensor 82 also subsequently misses the same stitch. It is possible because of dust or other interferance that the sensor 84 may miss a stitch even although the stitch is present, but if both sensors miss the stitch then the likelihood is that the stitch is missing and an alarm is given.

It is possible to use the pulse counting system of the sensors to control the speeds of the pull through rollers 54 and the sewing machine motor to provide very accurate control of stitch pitch. The pulse system can also be used to control the acceleration and deceleration of the sewing machine.

In a modified construction of each sewing machine, in order to reduce the vibration which is created by the reciprocatory motion of each sewing machine, there may be a counter balancing arrangement fitted to each sewing machine. This counter balancing arrangement is a mirror image of the drive arrangement shown in FIG. 7 insofaras a pair of similarly shaped cams, but offset by 180 degrees drive followers which in turn are connected to an contra balance mass. This enhances the operation of the machine, and a sketch of the arrangement is included herein as FIG. 9.

Referring to FIG. 9, it will be noticed that a belt transmission (200) connects an ancilliary shaft (202) which is provided with the balancing cams (204) which are for balancing the movement of the sewing machine. The balancing system is arranged to have all its moving parts equal in weight to the moving parts on the sewing machine. The motion of the balancing system is therefore arranged so that the vibrations generated by the sewing machine motion are effectively cancelled out.

I claim:

1. A sewing machine assembly for sewing a workpiece arranged to move continuously in a feed direction, said assembly comprising a sewing machine having a sewing needle and control means for reciprocating the needle to effect a sewing operation on the workpiece, a drive mechanism connected to the sewing machine, mounting means supporting the sewing machine for movement by the drive mechanism repeatedly in a forward stroke in said feed direction followed by a return stroke in a direction opposite to said feed direction, said drive means comprising drive shaft means, first and second cam means in driving engagement with said drive shaft means, and first and second cam follower means engaging said first and second cam means, said first cam means and first cam follower means being arranged to control the forward stroke of the sewing machine to accelerate the sewing machine from zero speed up to a predetermined speed and to decelerate the sewing machine from said predetermined speed to zero while the control means causes the needle during said forward stroke to penetrate the workpiece when the said predetermined speed has been reached and to be retracted from the workpiece before the sewing machine is decelerated, and the second cam means and second cam follower means are arranged to perform the return stroke in a time less than the time of the forward stroke.

2. An assembly according to claim 1 wherein said control means includes a micro processor for varying the acceleration and deceleration of the sewing machine depending upon the speed of movement of the workpiece.

3. An assembly according to claim 1 which includes drive roller means for moving the workpiece past the sewing machine.

4. An assembly according to claim 1 which includes drive roller means for moving the workpiece past the sewing machine.

5. An assembly according to claim 1, wherein there are two of said sewing machines arranged in sequence respectively for sewing webs into tubular form, with one tubular form being located inside the other.

6. An assembly according to claim 1 wherein the movement of the sewing machine is controlled by means of two cams so that during one cycle of operation, the forward stroke of the sewing machine is effected over an angular extent of the cycle of 270 degrees, while during the remaining 90 degrees the sewing machine is moved back to the beginning of the forward stroke position.

7. An assembly according to claim 6, wherein said mounting means comprises linear anti-friction bearings.

8. An assembly according to claim 6, wherein the sewing machine is adapted to sew overlapped or face-to-face edges of needle felt material.

9. An assembly according to claim 6, wherein there are two of said sewing machines arranged in sequence respectively for sewing webs into tubular form, with one tubular form being located inside the other.

10. An assembly according to claim 7, wherein the sewing machine is adapted to sew overlapped or face-to-face edges of needle felt material.

11. An assembly according to claim 7, wherein there are two of said sewing machines arranged in sequence respectively for sewing webs into tubular form, with one tubular form being located inside the other.

12. An assembly according to claim 10 wherein there are two of said sewing machines arranged in sequence respectively for sewing webs into tubular form, with one tubular form being located inside the other.

13. A method of sewing a workpiece comprising moving the workpiece past a sewing machine in a feed direction, at a workpiece speed said sewing machine having a needle for penetrating the workpiece, comprising carrying out repeatedly the steps of (a) moving the sewing machine in a forward stroke which is in the feed direction by accelerating the sewing machine from zero speed at the commencement of the forward stroke to the workpiece speed and then decelerating the sewing machine to zero speed at the end of the forward stroke, (b) sewing a stitch in the workpiece during the forward stroke when the sewing machine is travelling at the workpiece speed by causing the needle to penetrate and then retract from the workpiece, and (c) returning the sewing machine in a backward stroke to the commencement of the forward stroke in less time than the time taken for the forward stroke.

14. A method according to claim 13 wherein the workpiece is a flat web having web edges and which is folded to bring the edges together, and the sewing is effected through the said edges when brought together.

15. A method according to claim 13, wherein the sewing machine sews overlapped or face-to-face edges of needle felt material.

* * * * *